US005350268A

United States Patent [19]

Müller

[11] Patent Number: 5,350,268

[45] Date of Patent: Sep. 27, 1994

[54] METHOD FOR JOINING PAPER LAYERS

[76] Inventor: Erwin Müller, Kalchofenstrasse 25, 8635 Oberdürnten, Switzerland

[21] Appl. No.: 813,100

[22] Filed: Dec. 24, 1991

Related U.S. Application Data

[63] Continuation-in-part of Ser. No. 489,970, Mar. 7, 1990, abandoned.

[30] Foreign Application Priority Data

Mar. 30, 1989 [CH] Switzerland ..... 1156/89

[51] Int. Cl.[5] ..... B24C 11/00

[52] U.S. Cl. ..... 412/1; 412/5; 412/6

[58] Field of Search ..... 412/6, 33, 37, 39, 5

[56] References Cited

U.S. PATENT DOCUMENTS

| | | | |
|---|---|---|---|
| 3,321,558 | 5/1967 | Balamuth et al. | 263/52 |
| 3,706,503 | 12/1972 | Foley | 402/76 |
| 3,793,016 | 2/1974 | Eichorn | 96/1 R |
| 3,830,524 | 8/1974 | Abildgaard et al. | 156/73.1 |
| 3,925,126 | 12/1975 | Leatherman et al. | 412/900 |
| 4,149,288 | 4/1979 | Sendor et al. | 412/6 |
| 4,565,477 | 1/1986 | Axelrod | 412/5 |
| 4,575,122 | 3/1986 | Nava | 281/29 |
| 4,586,640 | 5/1986 | Smith | 412/33 X |
| 4,611,741 | 9/1986 | Wilson | 412/37 X |
| 4,915,415 | 4/1990 | Sendor et al. | 281/15.1 |
| 4,923,351 | 5/1990 | Nishikawa | 412/6 |
| 4,958,974 | 9/1990 | Schenk | 412/33 |

FOREIGN PATENT DOCUMENTS

| | | |
|---|---|---|
| 0014946 | 9/1980 | European Pat. Off. . |
| 0340334 | 11/1989 | European Pat. Off. . |
| 2126495 | 5/1971 | Fed. Rep. of Germany . |
| 1382415 | 11/1964 | France . |

OTHER PUBLICATIONS

"Ultrasonics: the new wave in sealing", Modern Packaging, Sep. 1979, vol. 52 No. 9, pp. 39–41.

*Primary Examiner*—Mark Rosenbaum
*Assistant Examiner*—Willmon Fridie, Jr.
*Attorney, Agent, or Firm*—Walter C. Farley

[57] ABSTRACT

A method binding paper layers is based on ultrasonic joining. The paper layers are pretreated before, during or after printing with a binder by pressing or spraying on, or by shooting in droplets. The ultrasonic action is carried out by means of a control means and an ultrasonic generator (20). The latter has a conical or knife edge-like binding tool, namely the sonotrode (24). During the ultrasonic action, the latter is pressed against the layers (26), which in turn rest on a plate or wrist-like abutment (27).

6 Claims, 7 Drawing Sheets

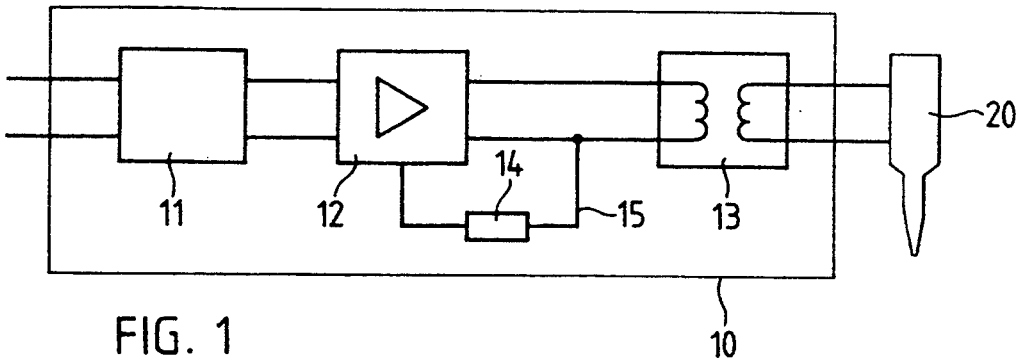
FIG. 1
PRIOR ART
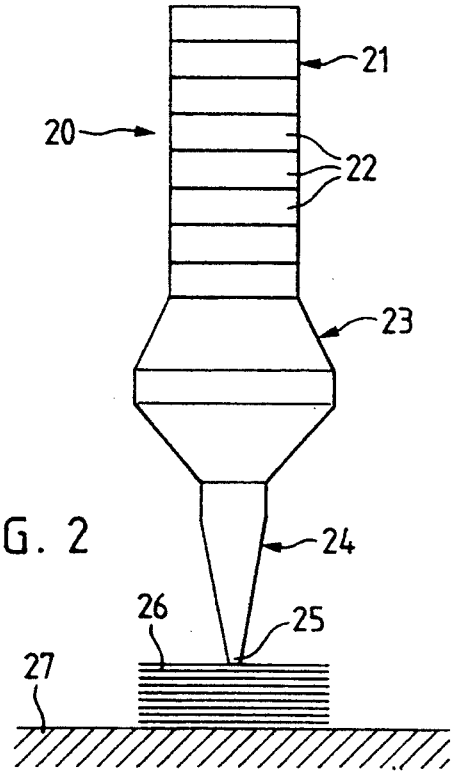
FIG. 2
FIG. 3
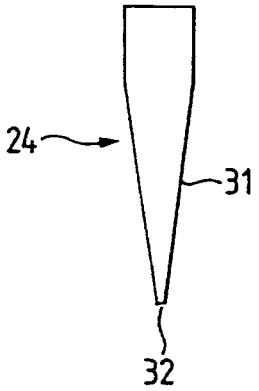
FIG. 4
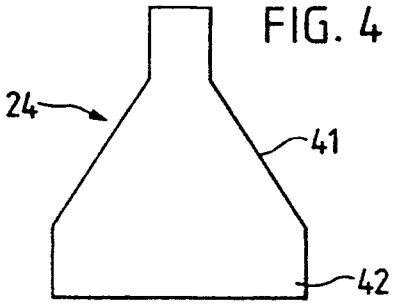
FIG. 5
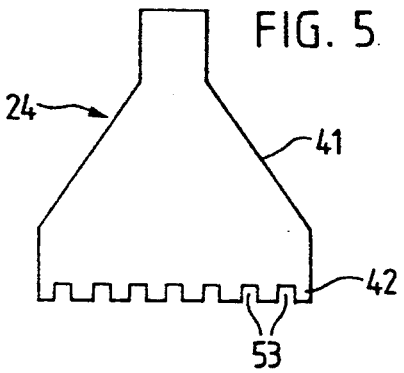

FIG. 6
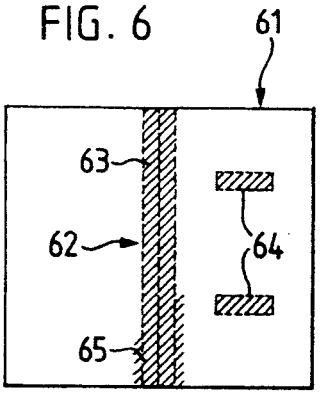
FIG. 7
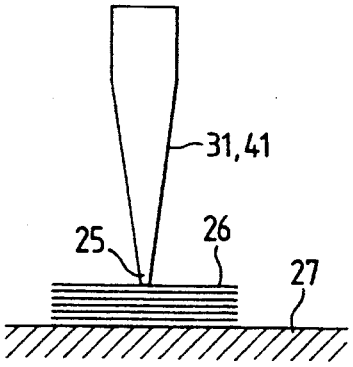
FIG. 8
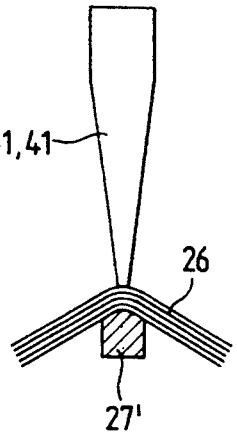
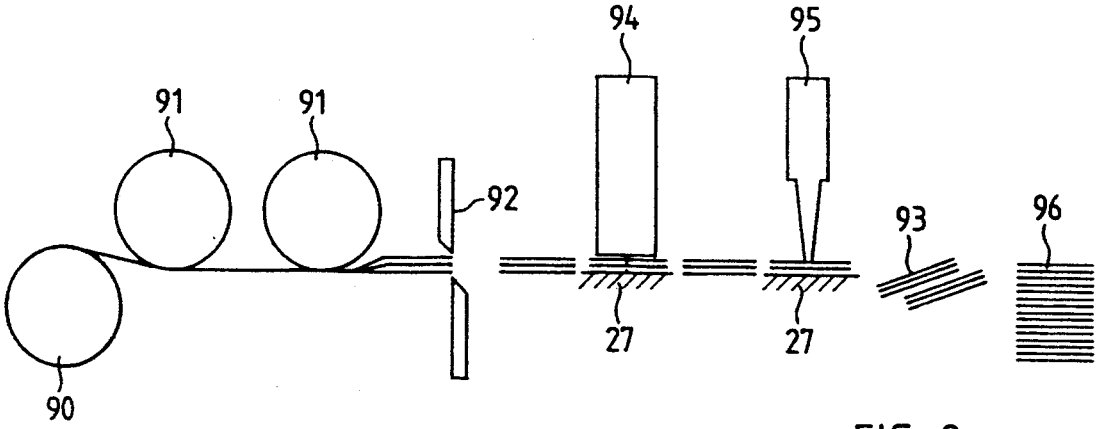
FIG. 9

METHOD FOR JOINING PAPER LAYERS

CROSS REFERENCE TO RELATED APPLICATION

This is a continuation-in-part of U.S. application Ser. No. 489,970, filed Mar. 7, 1990 and now abandoned.

FIELD OF THE INVENTION

The invention relates to a method for joining paper layers and to an apparatus for performing the method.

BACKGROUND OF THE INVENTION

Methods for joining or connecting paper layers have been known for decades and form an essential part of bookbinding. With the arrival of high-performance printing plants able to produce up to 100,000 printed products per hour, innovations were necessary with regards to the joining of the paper layers.

For the mass building of paper layers, such as occur in printing works, adhesive binding, thread stitching and wire stitching or stapling in particular have proved very satisfactory.

Adhesive binding is preferably used for binding books, catalogs and journals. Often various adhesion processes are combined with one another. For example, a low viscosity, high-wetting coating is first applied, followed by adhesion-improving coatings. This makes it possible to significantly improve the binding quality compared with simpler processes.

In glue-based adhesion, the glue application width is generally 4 mm. It is possible by gluing to bind approximately 15,000 copies per hour and in the production line a considerable area must be provided for glue drying. An important disadvantage of the process is the drying time which has to be given to the bonded product.

In summarizing, adhesive binding can be looked upon as a successful method for binding books, catalogs and journals. However, due to the necessary long drying time, with a few exceptions, this method is less suitable for the binding of booklets in a scale or flake stream or flow of separate paper layers of a printed product processing machine.

A further, proven method for the joining of paper layers is thread stitching, but it has been placed in the background by adhesive binding. Only because of a considerable increase in the stitching capacity has this method again acquired significance. Thread stitching has a number of advantages and disadvantages compared with adhesive binding. Whereas the adhesive binding quality is largely dependent on the paper type, thread stitching is largely independent of the paper quality.

Because it is a relatively slow method, thread stitching can be looked upon as suitable for high quality binding books. However, the greatest significance in connection with the stitching or stapling of printed matter in brochure or booklet form has been attached to wire stitching or stapling. Rotary wire stitchers have a high capacity, but are relatively expensive. A stitched copy can have up to 100 pages. In rotary wire stitching, the wire clip or staple is forced through the spread out paper stack against an abutment and without a locking mechanism.

Single wire stitches have a lower hourly capacity than rotary wire stitches and are also relatively expensive. However, the product can have over 300 pages.

Single wire stitchers have a stitching abutment with a locking mechanism.

An advantage of wire stitching is that it allows one to completely open the bound booklet. Also, there are no closed folded edges which might cover part of the printed information. However, a disadvantage of wire stitching is the material application through the staples in the back, which limits the stackability of products. Moreover, additional costs result from the choice, storage and processing of the appropriate wire material. There are also limits on the reliability of wire stitching, particularly in the case of thick paper layers with more than 200 pages.

Thus, there is interest in a method which can be integrated into the printed product processing operation of a high-performance printing press, i.e., which has an efficiency comparable to that of the wire stitching process, but without suffering from its disadvantages, such as, e.g., the use of metal. When seeking such a method, particular attention was paid to ensuring that the individual paper sheets do not separately have to undergo complicated preparation, such as e.g., the application of glue strips and also ensuring that there was no need for buffer or intermediate storage times due to long drying periods.

SUMMARY OF THE INVENTION

Therefore, an object of the invention is to provide a method for joining paper layers, while avoiding the disadvantages of the known paper stitching or binding methods. This object is achieved in that the paper layers to be joined are joined under ultrasonic action.

It is not obvious to ultrasonically weld together paper layers. Ultrasonic welding is admittedly known as a method for joining metals and plastics. According to known welding methods, the welding material is heated under ultrasonic action due to its internal friction in the contact region in such a way that there is a melting of the material to be joined and therefore a weld is obtained. Reference is made in this connection to the publication "Ultraschall für das Kunststoff-Fugen" by R. Altena, W. R. Behnke, L. Horvath, H. J. Rheinhardt and W. Ruhland, published by Branson Schallkraft GmbH, Industrie-strasse 48, D-6056 Huesenstamm, Germany.

Initially it did not appear appropriate to use ultrasonics for joining organic fibrous materials, such as paper, cardboard, wood or woven and non-woven fabrics, because such materials generally decompose under ultrasonic heat action and can even catch fire in the presence of oxygen. In particular, they cannot be brought into a liquid phase such as is necessary for welding.

However, our research has established that only a very thin coating is required to ensure an adequate adhesion between the paper layers. This coating can, e.g., be a printing ink which is applied during the printing process, or a thin, rapidly drying plastic film. Optionally a suitable binder can be incorporated during paper manufacture. The simultaneous action of heat, pressure and a vibratory movement lead to adequate adhesion of the paper layers, even when there is only a very small binder quantity.

Although the joining of paper layers by bonding is known, said process requires the application of an adhesive to the product to be adhered immediately prior to bonding. However, this requires an additional operation in which the paper sheets are individually provided with an adhesive and it must also be ensured that there is no premature contact between the paper sheets prepared for joining. However, the proposed ultrasonic process makes it possible to pretreat the paper simultaneously with the actual printing for subsequent joining purposes, i.e., the pretreatment process can be integrated into the printing process and in particular the further processing of the printed product, such as cutting, putting in order of the individual sheets and folding of the paper layers are not impeded or made more difficult by the joining pretreatment. It is particularly advantageous that the paper layers can be joined in a manner similar to wire or thread stitching.

BRIEF DESCRIPTION OF THE DRAWINGS

The invention is described in greater detail hereinafter relative to non-limitative embodiments and the attached drawings, wherein:

FIG. 1 is a schematic diagram of an ultrasonic welding apparatus, such as is used for joining plastics;

FIG. 2 is a schematic side elevation illustrating the principle of an ultrasonic transducer-booster-sonotrode means;

FIG. 3 is a side elevation of a sonotrode tip showing a conical shape of the tip;

FIGS. 4 and 5, respectively, are side elevations showing second and third shapes of the sonotrode in the form of a knife edge and as a knife edge with notches;

FIG. 6 is a plan view of a paper sheet with strip-like pretreatment;

FIG. 7 is an end elevation view of an apparatus for the ultrasonic welding of paper layers by means of a plate-like abutment;

FIG. 8 is an end elevation of an apparatus for welding paper layers along the back using a bar-like abutment;

FIG. 9 is a schematic diagram of a printing plant into which is integrated an ultrasonic welding apparatus;

DESCRIPTION OF THE PREFERRED EMBODIMENT

Figure 10:
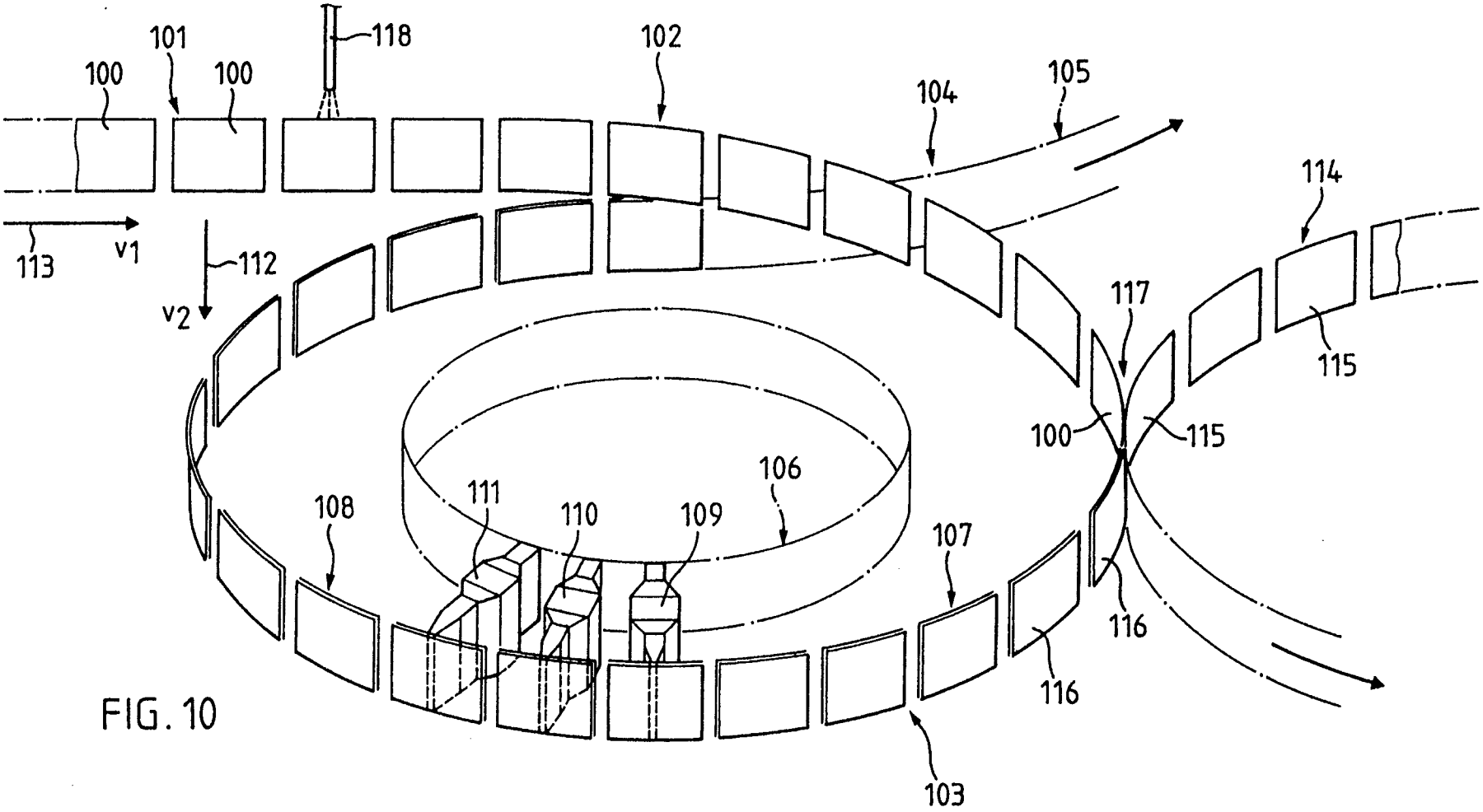
FIG. 10 is a schematic representation of a binding process.

FIG. 1 shows in exemplified manner the construction of an ultrasonic apparatus which can be used for welding plastics. The control means 10 comprises a source of power 11, an amplifier 12, a high frequency transformer 13 and a tunable positive feedback means 14 which is connected by the positive feedback line 15 to the input of amplifier 12 and to the primary of transformer 13. A frequency-determining element of the ultrasonic generator 20 is connected to the high frequency transformer. This circuit ensures that the ultrasonic generator 20 can be operated in acoustic resonance, which is necessary for a good transmission of the oscillation energy from the source to the working point. By tuning the positive feedback means 14, the phase position of the high frequency oscillator can be optimized.

FIG. 2 shows the basic construction of the ultrasonic generator 20. It generally comprises an ultrasonic transducer 21 and the oscillating tool or so-called sonotrode 24. The ultrasonic transducer 21 comprises a stack of parallel-connected piezoceramic plates 22. A sound amplitude transformer or booster 23 is optionally interposed between the ultrasonic transducer and the sonotrode. This passive element 23 leads to an increase or decrease in the oscillation amplitude. The sonotrode, which is the actual connecting or joining tool, ensures at its tip 25 the transmission of the ultrasonic power to the welding material 26 to be joined. An abutment 27 absorbs the contact pressure exerted by the sonotrode end on the material 26. The abutment 27 must be constructed in such a way that it absorbs a minimum amount of the ultrasonic power applied, i.e., it must have a very high mechanical inertia and must be very undeformable as compared with the welding material 26.

The system comprising ultrasonic transducers 21, booster 23 and sonotrode 24 is operated in acoustic resonance. A longitudinal oscillation is excited in most applications. Ultrasonic welding apparatuses generally operate at a frequency of 20 to 40 kHz. Typically the longitudinal oscillation amplitude at tip 25 of sonotrode 24 is approximately 100 μm at 20 kHz and approximately 50 μm at 40 kHz.

The apparatus, comprising the control means 10 and the ultrasonic generator 20, is generally operated by means of a control system in such a way that the mechanical amplitude at the sonotrode end 25, independently of the damping by the welding material 26, has a constant, predetermined value. In the case of more advantageous ultrasonic welding plants, in addition to the ultrasonic power, it is possible to predetermine the contact pressure exerted by the sonotrode end 25 on the welding material 26 as well as the ultrasonic action time.

The choice of the booster 23 and the shaping of the sonotrode 24 are a function of the nature of the welding material 26 and the weld to be carried out. Examples of the most standard sonotrode shapes and forms are described in the aforementioned work "Ultraschall für das Kunststoff-Fugen" by R. Altena et al.

FIGS. 3 to 5 show three examples of sonotrode shapes which are particularly appropriate for the uses discussed hereinafter. Thus, FIG. 3 shows a sonotrode 24 having a conical surface 31 ending in a tip 32, which is suitable for obtaining punctiform or spot welds.

FIG. 4 illustrates a sonotrode 24 with a flat sonotrode end 41 and a knife edge-like welding edge 42. This embodiment of sonotrode is particularly suitable for producing a long, narrow weld.

FIG. 5 shows a combination of the two embodiments of FIGS. 3 and 4. The flat sonotrode end 41 is knife edge-like, like 42 in FIG. 4. However, in order to increase the local contact pressure between sonotrode 24 and abutment 27, the welding edge 42 is provided with notches 53. Thus, weld points can be produced simultaneously in a long and narrow weld seam.

Using the apparatuses as shown in FIGS. 1 to 5, it is not possible to join layers of dry, unprinted paper. Corresponding tests only revealed a darkening or blackening, which can be attributed to the ultrasonically caused thermal action. A further step would be to permit the matting together of the individual paper fibers during the ultrasonic movement, particularly when the latter was directed transversely to the paper surface. Such matting was slightly detected in the case of a longitudinal movement.

Much better results can be obtained by slightly moistening the paper layers. In this case the paper structure is slightly damaged and a paper-making stock forms locally, such as occurs in paper manufacture. Much as in the paper manufacturing process, the subsequent ultrasonically-caused heating and pressing led to a matting and gluing of the paper fibers. This in itself permits limited adhesion of the paper layers.

However, even better results can be obtained if the paper is provided with a meltable coating, a very thin film being sufficient. Even when separating two paper layers, whereof one is printed using standard printing ink, while the other is unprinted, there is a partial transfer of the printing ink to the unprinted page after ultrasonic action. This means that the adhesion of the printing ink to the unprinted page is just as good as the adhesion during the original application. Strong printing, e.g., dark brown shades on glazed paper, such as are locally present in illustrated magazines, leads to very good adhesion under ultrasonic action.

In order to ensure a reliable connection, it is recommended that the paper be pretreated. Different possibilities exist in this connection.

FIG. 6 shows a sheet of paper pretreated for ultrasonic welding. In the fold region 62 of paper sheet 61 is defined a laterally bounded strip 63 which is provided with a film of printing ink or a plastic having a melting point at a higher temperature than the ink. Such strips 63 can e.g., be applied additionally or alternatively in region 64 of sheet 61, where subsequently inserted pages, entry or order forms, or art prints are to be inserted. The strip regions 63, 64 can either be applied to paper 61 during the printing process, e.g., by multiple coating by printing inks, especially using a printing dye containing a large amount of binder, or in an additional processing step.

Another pretreatment possibility for the subsequent ultrasonic welding of the paper 61 consists of a not sharply defined application of a colorless binder, e.g., a very thin plastic film. Such a pretreatment requires no change to the printing process, e.g., by using a special printing dye. The pretreatment can be brought about by spraying the printed page in the binding region. The material application, which generally occurs in the fold region in any case, would hardly have a prejudicial effect due to the minimum material application.

A further paper treatment consists of the paper sheet being pretreated over its whole surface for ultrasonic welding either during the manufacturing process or during or after the printing process. For example, additionally a desired glazed effect, moisture protection, or the like could be achieved by a pretreatment during or immediately after paper manufacture, or before or during the printing process.

As a further pretreatment procedure, binder or water could be injected into the fold region 63 of the already stacked paper layers. The paper layers can be pre-perforated and simultaneously or subsequently provided with binder or water by means of hollow or tubular needles. It is also possible to shoot liquid droplets into the paper layers as described in copending patent application Ser. No. 492,532 filed Mar. 7, 1990 and entitled "Process for the Adhesive Binding of Paper Layers".

Another possibility is for the abutment to be a chamfered abutment device 27' on which the paper layers are placed in the scale flow of the printing press, as shown in FIG. 8. In this case the abutment can be rod or wrist-like.

FIG. 9 schematically shows a simplified sequence in a printing plant with an integrated ultrasonic welding apparatus for paper layers. The paper comes from the paper loading device 90 to the printing mechanism 91, which can comprise several printing stages. The printed matter is then cut longitudinally and is optionally supplied to a cutting mechanism 92. The printed matter then e.g., passes to the welding pretreatment means 94, where binder is pressed or sprayed on. The printing material is subsequently bundled and conveyed on further. Optionally a welding pretreatment by shooting in binder can take place on the bundled paper layers. The printed matter then passes into the ultrasonic welding apparatus 95, where the paper layers are joined. The bundled products e.g., as a scale flow 93, are then received by the removal means 96.

FIG. 10 shows a schematic representation of essential steps of a binding process performed in a continuous stream. Layers of sheet material 100 are conveyed along a first path 101. Approximately at a location identified by numeral 102 this first path 101 reaches a second path 103 which defines a curved or substantially helical path along which the sheet material 100 is conveyed. At a location identified approximately by numeral 104, the second path reaches a third path 105 through which the bound material leaves the place where the binding process is performed, that is the second path 103. A fourth path 106, which is preferably a closed path, is arranged adjacent to the second path 103 and extends at least partially parallel to said second path 103. A portion in which paths 103 and 106 are parallel may start e.g., at a place 107 and end at a place 108. This fourth path 106 in fact is used for guiding a plurality of binding means 109, 110, and 111, of which only three examples are shown but which are distributed over the whole length of path 106. They are especially designed to move at the same speed as the sheet material in the second path 103. In fact, the sheet material and the binding means must be synchronized within portion 107,108 of the paths.

Because of the helical shape of the second path 103, the sheet material arriving in first path 101 at a speed v1 and a direction represented by arrow 113 will be redirected into a direction essentially as shown by arrow 112 and will also travel at a speed v2 in this direction. If sheet material is also fed in along a further path 114 and merges into path 103, an assembling process can be combined with the binding process. Therefore, the sheet material 115 arriving in path 114 simply has to be synchronized to the material 116 in the second path 103 and taken over by second path 103 at a location 117. Such synchronizing is accomplished with drive means not shown here but constructed according to state of the art. Since the binding process, which will be performed by the kind of ultrasonic welding already described takes some time to be performed, this condition will be met in said portion 107,108 of the second path 103. A pretreatment means 118 may be provided in the form of a nozzle spraying binder or other substances over the sheet material.

Figure 11:
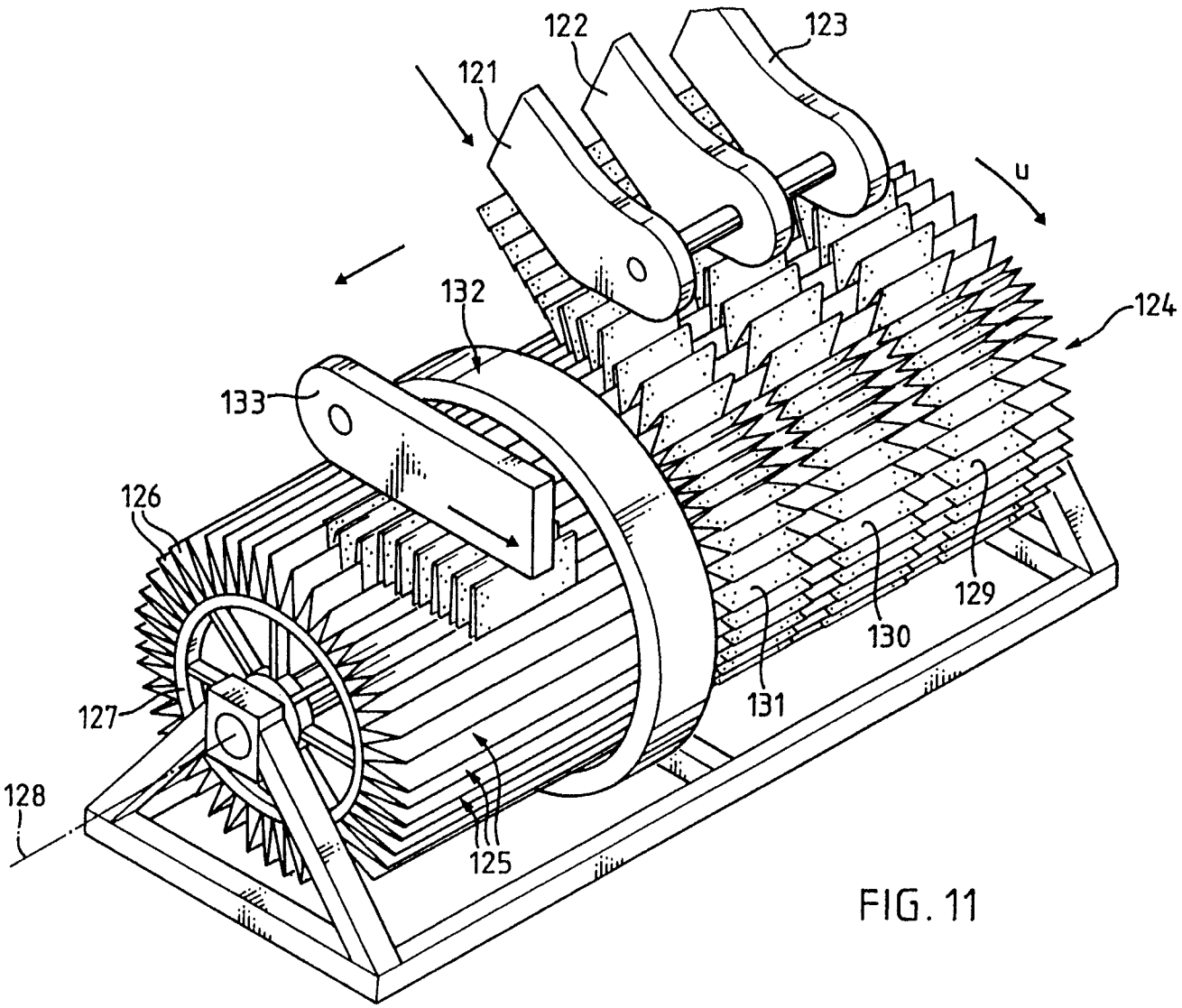
FIG. 11 is an apparatus for binding sheet material in a continuous flow.

FIG. 11 shows in more detail a corresponding apparatus for assembling and binding sheet material as already described with respect to FIG. 10. This apparatus is designed for collecting e.g., three streams of sheet material through inlets 121, 122 and 123. The inlets are designed for leading the sheet material into compartments 125 of a drum-shaped body 124, whose construction is basically known in the art. As a reminder, compartments 125 are separated by walls 126 attached to a cylindrical base member 127 which is also designed to rotate in a direction indicated by an arrow u about an axis 128. Each compartment 125 has means for displacing sheet material 129 sideways and parallel to axis 128 during rotation of body 124. In an already known process, sheet material 129 may be displaced sideways so as to match sheet material 130 and sheet materials 129 and 130 together may again be displaced to match sheet material 131. In this manner, sheet material 129, 130 and 131 will be assembled.

In a further step, assembled sheet material 131 may again be displaced sideways so as to get under an arrangement of ultrasonic welding heads 132, which is fixedly attached to body 124 and therefore rotates with it. A last sideways move in the same direction, that is to the left hand side of FIG. 11, will put the assembled and bound material under outputting device 133 which will output the material in a direction as indicated by arrow w. It is to be noted that each step which moves the sheet material sideways in the body 124 will be performed during one revolution of the body 124 but will not necessarily need all the time needed for one such revolution. The same is true for the step of binding the sheet material.

Figure 12:
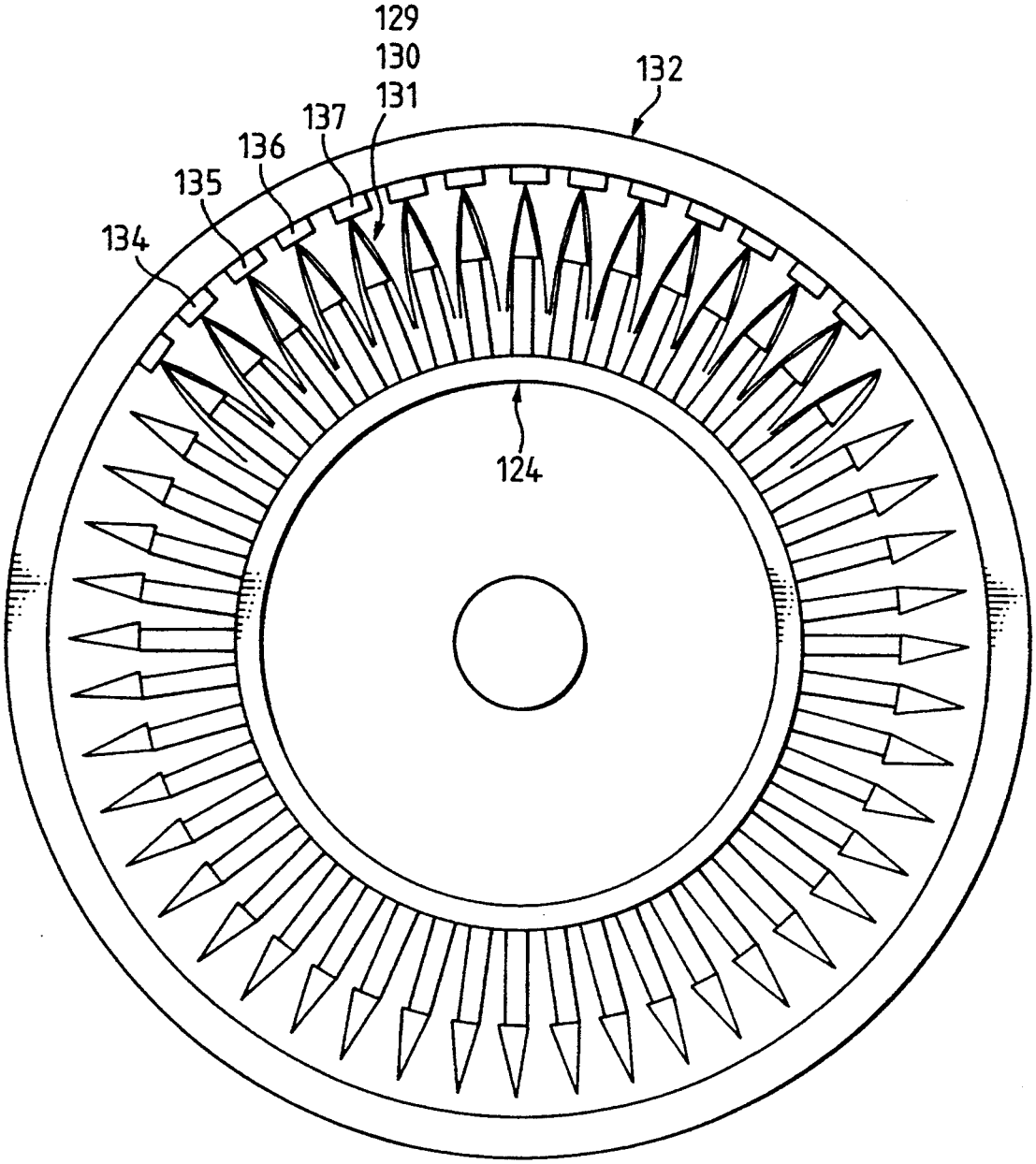
FIG. 12 is a section of the apparatus shown in FIG. 11.

FIG. 12 shows in more detail the arrangement of ultrasonic welding heads 132 and the body 124 as well as assembled sheet material 129, 130, and 131, as already known from FIG. 11. Individual welding heads are indicated by numerals 134, 135, 136, and 137 but are arranged over the whole circumference.

Figure 13:
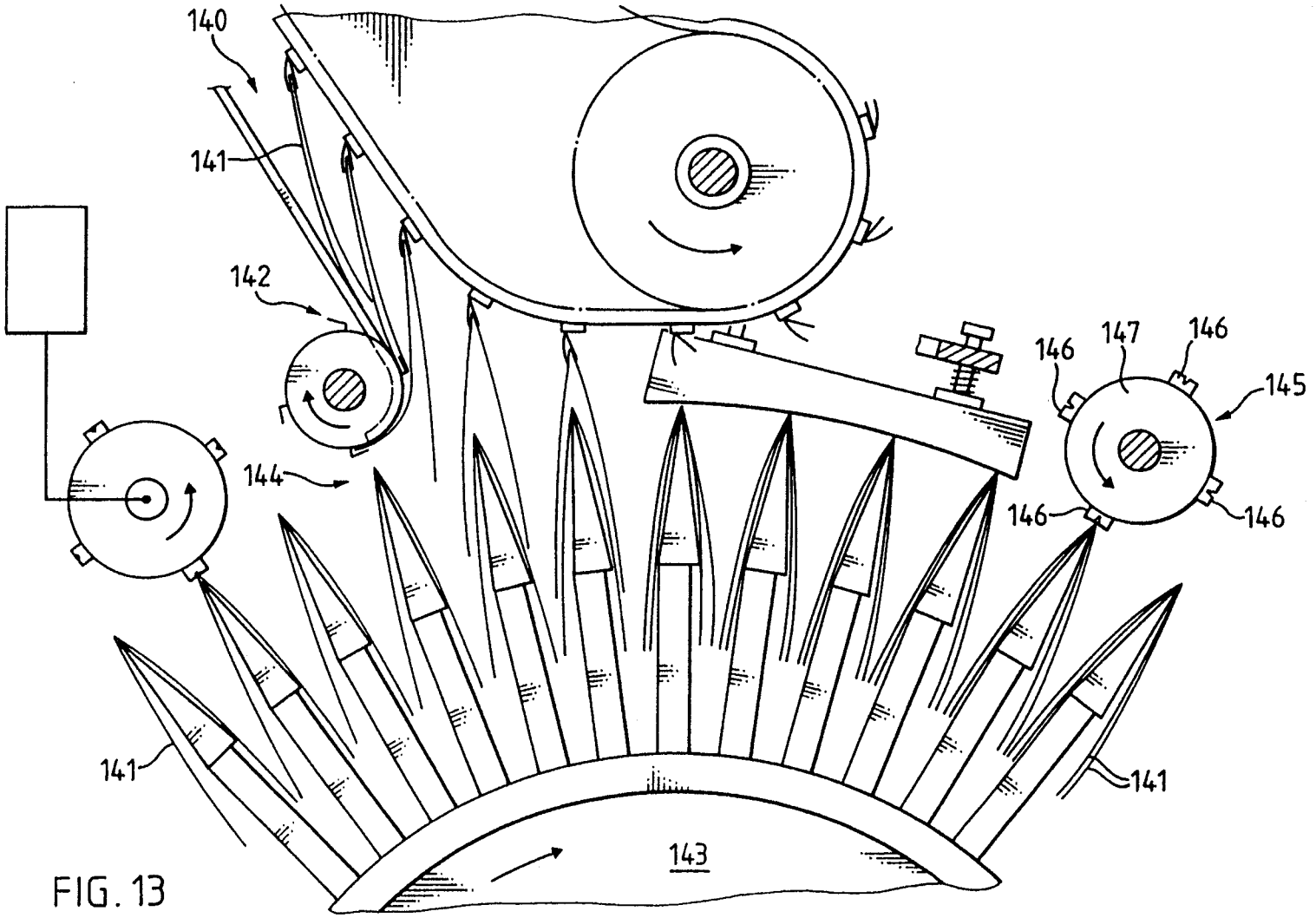
FIG. 13 is a part of an apparatus for binding sheet material in a continuous flow.

FIG. 13 shows a different arrangement including a first path 140 for the sheet material and an opener 142 for opening folded sheet material. Therefore, sheet material 141 is infed and opened prior to being discharged into an also already known drum 143 which defines a second curved path 144 for the sheet material to be bound. A fourth path 145 defining an area for the operation of welding heads 146 is arranged adjacent to second path 144. More specifically, it can be seen that welding heads 146 are arranged on a wheel 147 whose rotating movement is synchronized to the movement of the drum 143 by known means. In this manner ultrasonic welding can take place in a continuous process.

Figure 14:
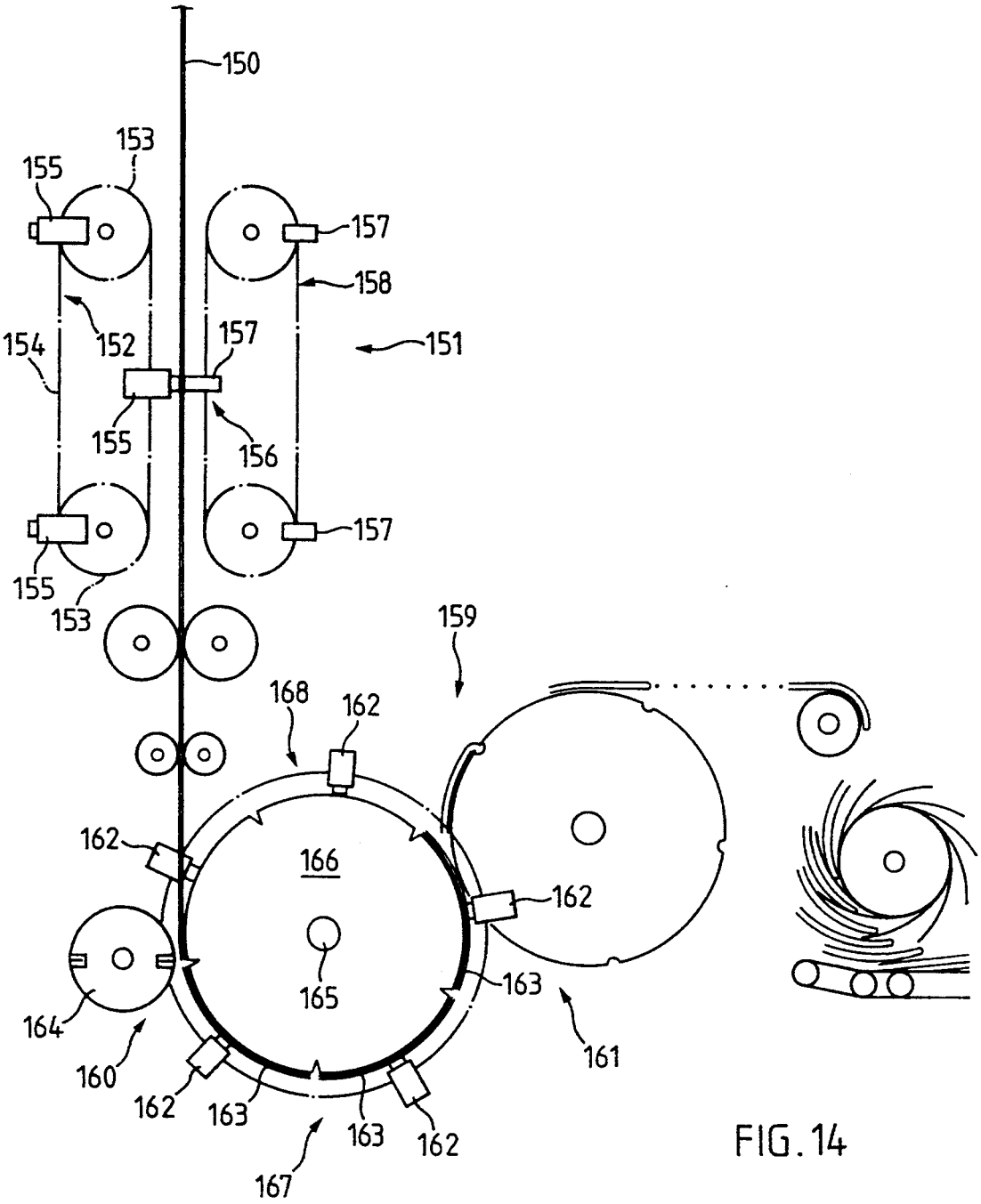
FIG. 14 is an apparatus for binding sheet material, the apparatus being part of a printing press.

FIG. 14 shows another embodiment of the invention where the binding process is performed on a stream 150 of sheet material, where the sheets are not separated. The stream 150 may comprise several layers of material to be bound in the binding device 151. This binding device 151 comprises a rotating support means 152 which may be a chain 154 driven by chain-wheels 153 and supporting a plurality of welding heads 155. On the other side of the stream 150 and symmetrically arranged is an abutment means 156 with a plurality of abutment elements 157 attached to a rotation support means 158 which may essentially corresponding to rotating support means 152. Both rotating support means 152 and 158 are synchronized by well-known, and therefore not shown, means to stream 150, in order to establish a fixed relationship with respect to phase and velocity. In this manner each welding head 155 will have its corresponding abutment element 157 pressing the stream against it during the time of welding. The welding takes place at locations which are defined on the stream and the synchronization is performed in such a manner that these locations are matched by the welding heads 155 and pressing elements 157. This kind of synchronization is already known in printing processes and therefore is not especially shown here. After passing the binding device 151 the stream 150 is treated in a well known manner and separated into single sheets or products composed of the bound sheets. This processing is performed in an apparatus 159 which comprises a cutting device 160 and a folding device 161. Both are parts of a printing press and therefore the binding device 151 is also integrated into such printing press when designed as represented in this FIG. 14.

A further aspect of the invention can be seen in FIG. 14 where the cutting device 160 is equipped with a number of ultrasonic welding heads 162. These welding heads 162 can perform their duty during a time needed for the products 163 to travel from the cutting cylinder 164 to the folding device 161. The welding heads 162 are arranged in a manner so as to be displaceable in a direction parallel to the axis 165 of the cylinder 166 while rotating with the cylinder 166. Such sideways moves are initiated e.g., in a well known manner by means of grooves arranged in cylinder 166 and cooperating with a member sliding in it. Such means are sliding the welding heads into operating position situated in an area 167 and a non-operating portion situated in an area 168.

What is claimed is:

1. A method for binding together layers of sheet material comprising the steps of conveying a stream of sheets of material traveling along a first path, providing a second path for the sheets of material, the second path continuously taking over the sheets of material delivered by the first path, carrying a plurality of binding means along a third closed path, the third path being at least partially parallel with the second path, binding sheets of the material together using ultrasonic energy while the sheets are moving along the second path, and delivering the bound material to a fourth path which received material substantially continuously from the second path.

2. A method according to claim 1 wherein said second path is substantially helical.

3. A method for binding together layers of sheet material comprising the steps of conveying a stream of sheets of material traveling along a first path, providing a second curved path for the sheets of material, the second path continuously taking over the sheets of material delivered by the first path, carrying a plurality of binding means along a third closed, curved path, the third path being at .least partially parallel with the second path, binding sheets of the material together using ultrasonic energy while the sheets are moving along the second path, and delivering the bound material to a fourth path which received material substantially continuously from the second path.

4. A method of binding together layers of sheet material including continuously conveying sheets of material along a path, and ultrasonically binding together the sheets of material while they are in continuous motion along the path.

5. A method of binding together layers of sheet material comprising the steps of conveying a stream of stacks of sheet material along a first path in substantially continuous motion, receiving the stacks of the first stream and without interruption conveying the stacks substantially continuously along a second, substantially circular path having an inlet location and an outlet location adjacent each other, carrying a plurality of binding means along a third, closed, curved path, the third path being at least partially parallel with the second path, binding sheets of the stacks of sheets together with the binding means moving along the third path while the stacks of sheets are moving without interruption along the second path, and delivering the bound stacks of sheets to a fourth path, the fourth path receiving material substantially continuously and without interruption from the second path.

6. A method of binding together stacked sheets of material while the material is being conveyed continuously at high speed comprising the steps of conveying the stacks of sheets through a binding loop, moving a plurality of ultrasonic heads along the binding loop at the same speed as the moving stacks, binding the sheets of each stack together by contacting the stacks with the ultrasonic heads while the stacks are traveling around the loop, and conveying bound stacks away from the loop.

* * * * *